US006653275B1

(12) United States Patent
Fender et al.

(10) Patent No.: US 6,653,275 B1
(45) Date of Patent: Nov. 25, 2003

(54) CLEAR SOFTENING AGENT FORMULATIONS

(75) Inventors: Michael Fender, Flieden (DE); Hans-Jurgen Kohle, Schluchtern (DE); Simone Schussler, Bad Orb (DE); Klaus Stark, Grundau (DE)

(73) Assignee: Goldschmidt Rewo GmbH & Co. KG, Steinau an der Strasse (DE)

( * ) Notice: Subject to any disclaimer, the term of this patent is extended or adjusted under 35 U.S.C. 154(b) by 0 days.

(21) Appl. No.: 09/856,581

(22) PCT Filed: Aug. 6, 1999

(86) PCT No.: PCT/EP99/05692

§ 371 (c)(1),
(2), (4) Date: May 23, 2001

(87) PCT Pub. No.: WO00/40681

PCT Pub. Date: Jul. 13, 2000

(30) Foreign Application Priority Data

Jan. 7, 1999 (EP) ..... 99100154

(51) Int. Cl.[7] ..... C11D 1/835

(52) U.S. Cl. ..... 510/527; 510/522

(58) Field of Search ..... 510/522, 527

(56) References Cited

U.S. PATENT DOCUMENTS

| | | | |
|---|---|---|---|
| 4,447,343 | A | 5/1984 | May et al. |
| 5,399,272 | A | 3/1995 | Swartley et al. |
| 5,492,636 | A | 2/1996 | Ansari et al. |

FOREIGN PATENT DOCUMENTS

| | | | |
|---|---|---|---|
| WO | WO 97/03169 | * | 1/1997 |
| WO | WO 97/23590 | * | 7/1997 |
| WO | WO 97/34975 | * | 9/1997 |

* cited by examiner

*Primary Examiner*—John Hardee
(74) *Attorney, Agent, or Firm*—Scully, Scott, Murphy & Presser

(57) ABSTRACT

The invention relates to fabric softener formulations based on one or more cationic surfactants and at least one further component, which give the overall formulation a transparent and clear appearance.

6 Claims, No Drawings

CLEAR SOFTENING AGENT FORMULATIONS

The invention relates to fabric softener formulations based on one or more cationic surfactants and at least one further component, which give the overall formulation a transparent and clear appearance.

Over the course of time, the laundry detergent industry has developed fabric softener formulations with improved rewetting capacity, high stability and a good soft handle. The great majority of these formulations enter the market as aqueous dispersions. Examples of the formulation of dispersions are described, inter alia, in DE 37 20 331, DE 42 03 489, and EP 0 413 249.

The formulations prepared in accordance with the specifications given therein, however, require large amounts of energy for their preparation and tend toward severe fluctuations in viscosity, especially at high storage temperatures. Furthermore, it is known that agglomerates in fabric softener dispersions lead to spotting on the treated textiles.

U.S. Pat. No. 5,545,340 describes homogeneous fabric softener formulations which comprise mixtures of a solid quaternary ammonium compound in a dispersing aid and of a liquid quaternary ammonium compound in a dispersing aid, and also a liquid carrier material, and in which fatty acids having a defined cis/trans ratio to the iodine number are used to prepare the quaternary ammonium compound. These fabric softener formulations, however, do not form clear solutions.

Against the background of heightened esthetic awareness, a prejudice has become established against the disperse fabric softener formulations. Among consumers, an increasing requirement is noted for formulations with a naturally clear appearance.

Flowable, highly concentrated and clear fabric softener formulations have already been described, as for example in DE 33 14 677, DE 36 08 093.

The highly concentrated products described therein, containing generally >35% of quaternary fabric softener base materials, have the disadvantage, however, that these formulations are difficult to dilute with water and/or that, during the rinsing of this highly concentrated formulation in the dispenser drawer of the washing machine, gels of poor solubility in water are formed, and uniform treatment of the textile is not ensured. Furthermore, with these highly concentrated fabric softeners, instances of overdosing are frequent, leading to spotting on the fabrics thus treated.

It was an object of the present invention, therefore, to avoid these disadvantages of the prior art and to provide fabric softener formulations whose activity spectrum is at least equal to that of the comparable prior art products but which additionally possess a clear and transparent appearance, whose preparation can be carried out at reduced energy consumption, and whose handling ensures a trouble-free application among the end users.

It has now been found that fabric softener formulations consisting predominantly of cationic surfactants and 5–30% by weight, based on overall formulation, of a further compound meet these requirements.

The invention accordingly provides clear and transparent fabric softener formulations comprising A) 15–35% by weight of at least one quaternary ammonium compound of the general formula (I)

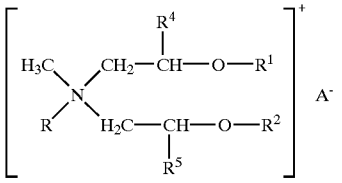

(I)

and

B) 5–30% by weight of at least one of the compounds of the general formula (II)

$$R^6—(CH_2)_a—O(—CH_2—CH_2(R^4)—O—)_nH$$

where

R=—$CH_3$, —$CH_2$—CH($R^4$)—O$R^1$,—$CH_2$—CH($R^5$)—O$R^2$, in which $R^4$, $R^5$ may be identical or different and are H or —$CH_3$, $R^1$ and $R^2$=H, —C(O)—$R^3$ in which $R^3$ is an optionally substituted hydrocarbon radical having 13–19 carbon atoms and containing at least one double bond, with the proviso that when R≠$CH_3$ $R^1$ and $R^2$=H at least 1 to 1.4 times, and when R=$CH_3$ $R^1$ and $R^2$=H at most 0.4 times $R^6$=a phenyl radical optionally containing $C_{1-4}$ alkyl groups, or a branched alkyl radical having 3 to 6 carbon atoms n=0 to8, a=0 or 1

A can be=anion of a quaternizing agent, in particular of dimethyl sulfate, diethyl sulfate, methyl chloride, and C) 0.5–18% by weight of customary auxiliaries and additives, and D) ad 100% by weight of water.

Also provided are clear fabric softener formulations as claimed in claim 1, characterized in that the compounds of the general formula (I) are prepared by esterifying at least one of the alkanolamine compounds from the group methyldiethanolamine, methylethanolisopropanolamine, methyldiisopropanolamine, triisopropanolamine, triethanolamine and fatty acids, followed by quaternization.

Also provided are clear fabric softener formulations as claimed in claim 1, characterized in that the compounds of the general formula (I) are prepared by esterifying alkanolamines and fatty acids in the molar ratio from 1:1.6 to 1:2, followed by quaternization.

Further subject-matter of the invention is defined by the claims.

The quaternary compounds of the general formula (I) that are used in accordance with the invention are prepared in accordance with the processes which are common knowledge in this field, by esterification of alkanolamines such as triethanolamine (TEA), methyldiethanolamine (MDEA), methyldiisopropanolamine (MDIA), methylethanolisopropanolamine (MEIPA), triisopropanolamine (TIPA) with fatty acid, followed by quaternization.

Particularly widespread are ester compounds based on triethanolamine, such as N-methyl, N,N-bis(beta-$C_{14-18}$ acyloxyethyl), N-beta-hydroxyethylammonium methosulfate), which are sold under trade names such as TETRANYL® AT 75 (trademark of KAO Corp.), STEPANTEX® VRH 90 (trademark of Stepan Corp.) or REWOQUAT® WE 18 (trademark of Witco Surfactants GmbH).

Fatty acids used for the esterification or transesterification are the monobasic fatty acids that are customary and known in this field, based on natural vegetable or animal oils with 6–22 carbon atoms, especially with 14–18 carbon atoms, such as oleic acid, linoleic acid, linolenic acid, and especially rapeseed oil fatty acid, soybean oil fatty acid, sunflower oil fatty acid, tall oil fatty acid, which may be used alone or in a mixture in the form of their glycerides, methyl or ethyl esters, or as the free acids. In principle, all fatty acids with similar chain distribution are suitable.

The proportion of unsaturated fractions in these fatty acids and fatty acid esters is adjusted—where necessary—to a desired iodine number by means of the known catalytic hydrogenation processes, or is obtained by blending fully hydrogenated with unhydrogenated fatty components.

The iodine number, as a measure of the average degree of saturation of a fatty acid, is the amount of iodine absorbed by 100 g of the compound in order to saturate the double bonds.

Preference is given in accordance with the invention to fatty acids having iodine numbers in the range from approximately 40 to 160, but especially rapeseed oil fatty acids, sunflower oil fatty acids, soybean oil fatty acids, and tall oil fatty acids having iodine numbers in the range from approximately 80 to 150. They are commercially customary products and are sold by different companies under their respective trade names.

The esterification or transesterification is conducted in accordance with known processes. In these processes, the alkanolamine is reacted with the amount of fatty acid or fatty acid ester corresponding to the desired degree of esterification, in the presence if desired of a catalyst, e.g. methanesulfonic acid, under nitrogen at 160–240° C., and the water of reaction which forms, or the alcohol, is distilled off continuously, it being possible if desired to reduce the pressure in order to complete the reaction.

For the preparation of the esters, in a first stage the fatty acids and the alkanolamine are reacted in a ratio such as to result, with a view to the desired performance properties of the end products, in a degree of esterification of from 1.6 to 2.0; in accordance with the invention, particular preference is given to a degree of esterification of from 1.8 to 2.0. The compounds prepared in this way are technical reaction mixtures, present predominantly as diesters.

The subsequent quaternization also takes place in accordance with known processes. In accordance with the invention the procedure is such that the ester, with or without the use of a solvent, preferably isopropanol, ethanol, 1,2-propylene glycol and/or dipropylene glycol, is admixed at 60–90° C. with equimolar amounts of the quaternizing agent, with stirring, under superatmospheric pressure if desired, and the completion of the reaction is monitored by checking the total amine number.

Examples of the quaternizing agents used are organic or inorganic acids, but preferably short-chain dialkyl phosphates and dialkyl sulfates such as, in particular, dimethyl sulfate, diethyl sulfate, dimethyl phosphate, diethyl phosphate, short-chain halogenated hydrocarbons, especially methyl chloride.

For the preparation of the quaternary ammonium compounds in accordance with general formula (I), fatty acids set out below were used.

Fatty Acid I (FA I)

Oleic acid having an acid number of 198–204, an iodine number of approximately 95 and a carbon chain distribution of

| | | |
|---|---|---|
| <C16 | about 4% | |
| C16 | about 5% | |
| C16' | about 5% | ('monounsaturated) |
| C17 | about 1% | |
| C18 | about 2% | |
| C18' | about 70% | |
| C18" | about 12% | ("diunsaturated) |
| >C18 | about 2% | |

Fatty Acid II (FA II)

Rapeseed oil fatty acid having an acid number of 196–204, an iodine number of approximately 98 and a carbon chain distribution of

| | |
|---|---|
| <C16 | about 2% |
| C16 | about 5% |
| C16' | about 1% |
| C17 | |

-continued

| | |
|---|---|
| C18 | about 3% |
| C18' | about 73% |
| C18" | about 14% |
| >C18 | about 2% |

Fatty Acid III (FA III)

Tall oil fatty acid having an acid number of 190–198, an iodine number of approximately 150 and a carbon chain distribution of

| | |
|---|---|
| C16 | about 1% |
| C16' | — |
| C17 | — |
| C18 | about 2% |
| C18' | about 37% |
| C18" | about 60% |
| >C18 | about 1% |

As examples of the quaternary ammonium compounds in accordance with formula (I), the following compounds were used:

| | | |
|---|---|---|
| Component A1: | TEA: FA I | = 1:1.75 |
| Component A2: | TEA:FA II | = 1:2.0 |
| Component A3: | MDEA:FA | = 1:1.85 |
| Component A4: | MEIPA:FA II | = 1:1.9 |
| Component A5: | MDIA:FA III | = 1:1.8 |

Components A1–A5 were quaternized with dimethyl sulfate and contained 10% by mass of isopropanol as solvent. The references below to components $A^1$ to $A^5$ denote these quaternized compounds.

Component B1: $R^6$=phenyl; $R^4$=H; n=4

Component B2: $R^6$=i—$C_4H_9$ (about 60%)*; n=0

Sold under the trade name Isanol (Biesterfeld, Hamburg)

Component B3: $R^6$=I—$C_4H_9$(about 60%)*; R4=H; n=2.7

Component B4: $R^6$-i=$C_4H_9$ (about 60%)*; R4=$CH_3$; n=2.7

Also used as component B are alkoxylated phenols, which may contain one or more alkyl substituents, such as, for example, ethoxylated and/or propoxylated phenol, o/m/p-cresol, thymol, p-tert-butyl-phenol, benzyl alcohol. In accordance with the invention, it is also possible to use optionally alkoxylated branched short-chain alcohols having 3 to 6 carbon atoms, such as isopropanol, butan-2-ol, 2-methylpropan-1-ol, 3-methylbutan-1-ol, 2-methylbutan-1-ol, and their alkoxylation products.

The degree of alkoxylation is from 0 to about 8, preference being given in accordance with the invention to technical mixtures having an average degree of alkoxylation of 0 or >2.5 to about 3.5. The compounds of component B may be employed as a mixture with one another and/or together with one another in amounts of about 5 to 30% by weight, based on the overall mixture, preferably in amounts from 10 to 25% by weight.

The fabric softeners are prepared by emulsifying or dissolving the quaternized compounds $A^1$–$A^5$, together with the use of compounds of the general formula B, by introducing the respective individual components into water, with stirring. In this context it is possible in principle to employ the procedures which are customary in this field.

In accordance with the invention, a procedure is followed in which water at room temperature is introduced initially, and, with effective stirring, first the dye solution, then any antifoam emulsion required, and, finally, the softener and component B), as a mixture or in any desired order, are introduced with stirring. This is followed by the addition of perfume oil and, if desired, a certain amount of an electrolyte solution, in order to reduce the viscosity of the finished formulation. The fabric softeners of the invention may comprise the stated components within the limits which are customary in this field, such as, for example, from 15 to 35% by weight of the compounds of the general formula A; 5 to 30% by weight of at least one of the compounds of the general formula B; from 0.5 to 18% by weight of one or more of the customary auxiliaries and additives such as, for example, from 0.05 to 1% by weight of dyes, from 0.05 to 1% by weight of preservatives, from 0.1 to 12% by weight of short-chain alcohols/diols having 2 to 6 carbon atoms, from 0.1 to 1% by weight of defoaming agents, and also, in particular, from 0.1 to 1.5% by weight of an alkali metal salt and/or alkaline earth metal salt; from 0.1 to 1.5% by weight of perfume oil, and the remainder to 100% by weight (ad 100) of water.

Like the fabric softeners belonging to the known prior art, the fabric softeners of the invention are added in the last rinse cycle following the actual washing operation. Depending on the area of application, the concentration in which they are employed, following dilution with water, is within the range from 0.1 to 10 g of fabric softener per liter of treatment liquor.

EXAMPLES

General Instructions for Preparing Clear Fabric Softener Formulations

Demineralized water is initially introduced at room temperature, the dye solution is added, and the quaternary ammonium compound (quat; component A) is mixed slowly into the water phase with continual stirring. Subsequently, component B is added with stirring to the mixture of water and quat, until it forms a clear solution at 20° C. This formulation is then cooled to 4° C., and must be clearly transparent at this temperature. If necessary, an additional quantity of solubilizer B is introduced with stirring until the mixture is clear at 4° C. At the same time as, or before or after, the addition of component B, alcohols, preferably glycols with boiling points >120° C., may be incorporated into the reaction mixture with stirring in order to increase the flash point of the finished formulation.

Subsequently, the perfume oil is added with stirring at room temperature and, if desired, mineral salts are added in order to adjust the viscosity in the case of highly viscous solutions, so as to improve the stirrability and flowability of the mixture.

Mineral salts which may be used comprise in particular the chlorides of alkali metals or alkaline earth metals in amounts from about 0.1 to 1.5% by weight, preferably in the form of their aqueous solutions with a strength of from 10 to 30%, in particular an aqueous calcium chloride solution.

Example 1

| | |
|---|---|
| Water | 47.4 parts by mass |
| Dye* | 0.8 part by mass |

-continued

| | |
|---|---|
| Component A1 | 30.6 parts by mass |
| Component B1 | 18.0 parts by mass<br>Product is clear at 20° C. |
| Propylene glycol | 2.0 parts by mass<br>Product is clear at 4° C. |
| Perfume oil** | 0.8 part by mass |

Dye*: 1% strength solution of SAND0LAN ®Walkblau NBL 150 from Sandoz

Dye*: 1% strength solution of SANDOLAN®Walkblau NBL 150 from Sandoz

Perfume oil**: Fragrances® D 60515 W from Haarmann and Reimer GmbH

Example 2

| | |
|---|---|
| Water | 47.4 parts by mass |
| Dye* | 0.8 part by mass |
| Component A4 | 30.6 parts by mass |
| Component B1 | 22.0 parts by mass<br>Product is clear at 20° C. |
| Component B2 | 2.0 parts by mass<br>Product is clear at 4° C. |
| Perfume oil** | 0.8 part by mass |

Example 3

| | |
|---|---|
| Water | 59.4 parts by mass |
| Dye* | 0.8 part by mass |
| Component A3 | 30.6 parts by mass |
| Component B2 | 10.0 parts by mass |
| Perfume oil** | 0.8 part by mass |
| $CaCl_2$ solution*** | 1.0 part by mass<br>Product is clear at 20° C. and at 4° C. |

$CaCl_2$ solution*: 25% by weight in water $CaCl_2$ solution*: 25% by weight in water

Example 4

| | |
|---|---|
| Water | 51.4 parts by mass |
| Dye* | 0.8 part by mass |
| Component A4 | 30.6 parts by mass |
| Component B2 | 6.0 parts by mass |
| Hexylene glycol | 12.0 parts by mass |
| Perfume oil** | 0.8 part by mass<br>Product is clear at 20° C. and at 4° C. |

Example 5

| | |
|---|---|
| Water | 44.9 parts by mass |
| Dye* | 0.8 part by mass |
| Component A2 | 30.6 parts by mass |
| Component B3 | 12.5 parts by mass |
| Hexylene glycol | 12.0 parts by mass |
| Perfume oil** | 0.8 part by mass<br>Product is clear at 20° C. and at 4° C. |

Example 6

| | |
|---|---|
| Water | 55.4 parts by mass |
| Dye* | 0.8 part by mass |
| Component A1 | 30.6 parts by mass |
| Component B4 | 10.0 parts by mass |
| Component B2 | 6.0 parts by mass |
| Perfume oil** | 0.8 part by mass |
| | Product is clear at 20° C. and at 4° C. |

Example 7

| | |
|---|---|
| Water | 46.4 parts by mass |
| Dye* | 0.8 part by mass |
| Component A5 | 30.6 parts by mass |
| Component B4 | 13.0 parts by mass |
| Dipropylene glycol | 5.0 parts by mass |
| Perfume oil** | 0.8 part by mass |
| | Product is clear at 20° C. and at 4° C. |

What is claimed is:

1. The clear fabric softener formulation comprising:

A) 15–35% by weight of at least one quaternary ammonium compound of general formula (I)

(I)

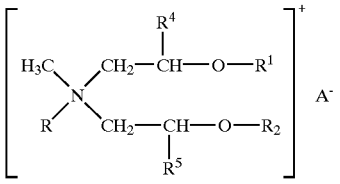

wherein R=—$CH_3$, —$CH_2$—CH($R^4$)—O$R^1$ or —$CH_2$—CH($R^5$)—O$R^2$, in which $R^4$ and $R^5$ may be identical or different and are H or —$CH_3$ $R^1$ and $R^2$=H or —C(O)—$R^3$ in which $R^3$ is an optionally substituted hydrocarbon radical having 13–19 carbon atoms and containing at least one double bond, with the proviso that when R is other than $CH_3$, $R^1$ and $R^2$=H at least 1 to 1.4 times, and when R=$CH_3$, $R^1$ and $R^2$=H at most 0.4 times, and $A^-$ is an anion of a quaternzing agent;

B) 5–30% by weight of an ethoxylated or propoxylated phenol, benzyl, isopropanol, isobutanol or mixtures thereof having an average degree of alkoxylation of >2.5 to 3.5;

C) 0.5–18% by weight of customary auxiliaries and additives; and

D) ad 100% by weight of water.

2. The clear fabric softener formulation as claimed in claim 1, characterized in that the compounds of the general formula (I) are prepared by esterifying at least one alkanolamine compounds from the group of methyldiethanolamine, methylethanolisopropanolamine, methyldiisopropanolamine, triisopropanolamine, triethanolamine and fatty acids and subsequent quaternization.

3. The clear fabric softener formulation as claimed in claim 1, characterized in that the compounds of the general formula (I) are prepared by esterifying alkanolamines and fatty acids in a molar ratio of from 1:1.6 to 1:2 and subsequent quaternization.

4. The clear fabric softener formulation as claimed in claim 1, characterized in that the compounds of the general formula (I) are prepared by esterifying alkanolamines and at least one fatty acid selected from the group consisting of rapeseed oil fatty acids, sunflower oil fatty acids, soybean oil fatty acids and tall oil fatty acid.

5. The clear fabric softener formulation as claimed in claim 1, characterized in that the compounds of the general formula (I) are prepared by esterifying alkanolamines and at least one fatty acid having iodine numbers in the range from 40 to 160.

6. The clear fabric softener formulation as claimed in claim 1, characterized in that the compounds of the general formula (I) are prepared by esterfying alkanolamines and at least one fatty acid having iodine numbers in the range from 80 to 150.

* * * * *